US005703430A

United States Patent [19]

Dekker

[11] Patent Number: 5,703,430

[45] Date of Patent: Dec. 30, 1997

[54] COLOR CATHODE RAY TUBE WITH EDDY CURRENT REDUCING ELECTRON GUN

[75] Inventor: Martijn J. Dekker, Eindhoven, Netherlands

[73] Assignee: U.S. Philips Corporation, New York, N.Y.

[21] Appl. No.: 698,640

[22] Filed: Aug. 16, 1996

[30] Foreign Application Priority Data

Aug. 18, 1995 [EP] European Pat. Off. ..... 95202235

[51] Int. Cl.[6] ..... H01J 29/51

[52] U.S. Cl. ..... 313/409; 313/412; 313/414; 313/413

[58] Field of Search ..... 313/409, 412, 313/413, 414, 448, 449, 458

[56] References Cited

U.S. PATENT DOCUMENTS

| | | | |
|---|---|---|---|
| 4,593,226 | 6/1986 | Naiki | 313/412 |
| 4,625,145 | 11/1986 | Gerritsen et al. | 313/413 |
| 4,659,961 | 4/1987 | Naiki | 313/413 |

*Primary Examiner*—Nimeshkumar Patel

*Attorney, Agent, or Firm*—John C. Fox; Norman N. Spain

[57] ABSTRACT

The centering cup of an in-line electron gun of a color cathode ray tube is provided with four slits, positioned substantially mirror-symmetrical with respect to the in-line plane and with respect to a plane perpendicular to the in-line plane through the central aperture, a line drawn through two slits and the central opening making an angle with the in-line plane ranging between 51 and 63 degrees. The slits reduce the occurrence of eddy currents, without introducing convergence errors.

2 Claims, 4 Drawing Sheets

COLOR CATHODE RAY TUBE WITH EDDY CURRENT REDUCING ELECTRON GUN

BACKGROUND OF THE INVENTION

The present invention relates to a colour cathode ray tube comprising in an evacuated envelope an in-line electron gun for generating three electron beams situated in one plane, said electron beams being directed to a display screen on an interior portion of the evacuated envelope, and a deflection unit for deflecting the electron beams over the screen, said electron gun comprising a centering cup at the end of the electron gun facing the display screen, said centering cup having a central and two outer apertures for passing the three electron beams.

Such colour cathode ray tubes are known and are used, inter alia in television receivers and colour monitors.

In operation the deflection unit generates an electromagnetic field for deflecting the electron beams generated by the in-line electron gun over the display screen. The deflection field induces eddy current in the centering cup. These eddy currents have a negative influence on the image quality. The three electron beams are converged on the display screen. The picture quality is amongst others determined by the convergence of the beams on the display screen.

OBJECTS AND SUMMARY OF THE INVENTION

It is an object of the invention to reduce the negative effects of the eddy currents without introducing substantial changes in the convergence of the electron beams.

Hereto the colour cathode ray tube according to the invention is characterized in that the centering cup is provided with four slits, positioned substantially mirror-symmetrical with respect to the in-line plane and with respect to a plane perpendicular to the in-line plane through the central aperture, a line drawn through two slits and the central opening making an angle with the in-line plane ranging between 51 and 63 degrees.

It has been found within the framework of the invention that in a colour cathode ray tube in accordance with the invention the occurrence of eddy currents in the centering cup is strongly reduced, while no or little convergence errors are introduced.

These and other aspects of the invention will below be further illustrated, by way of example with reference to a drawing in which

DESCRIPTION OF THE PREFERRED EMBODIMENTS

Figure 1:
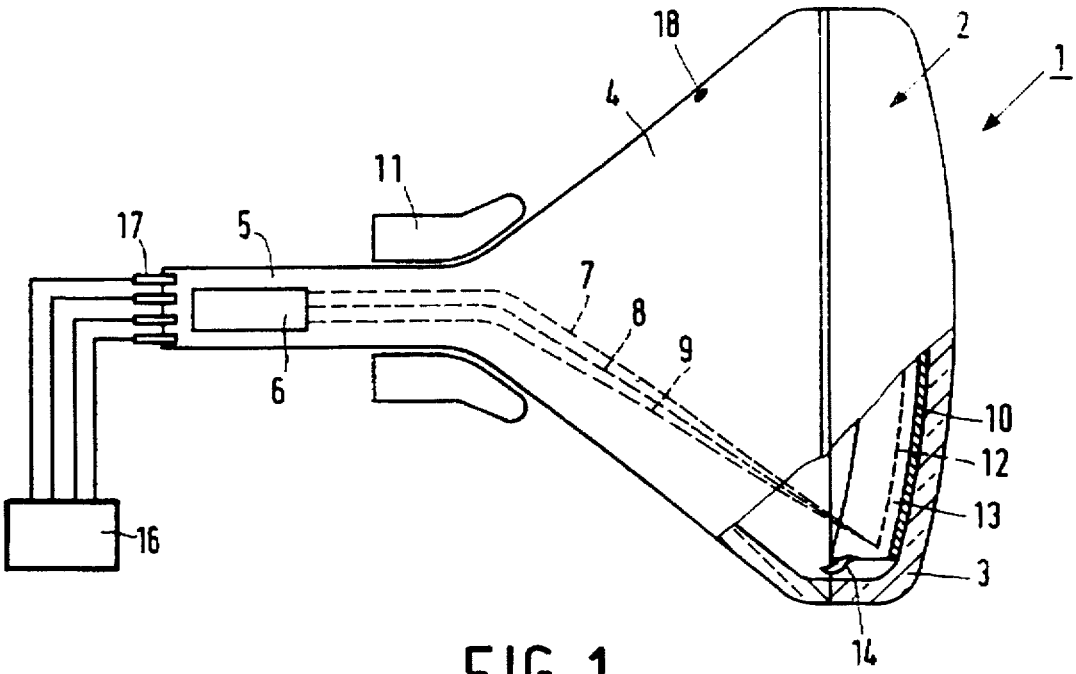
FIG. 1 is a longitudinal section of a colour cathode ray tube according to the invention.

FIG. 1 shows a colour display tube of the "in-line" type in a longitudinal section. In a glass envelope 1, which is composed of a display window 2 having a face plate 3, a cone 4 and a neck 5, this neck accommodates an integrated electron gun system 6 which generates three electron beams 7, 8 and 9 whose axes are located in the plane of the drawing. The axis of the central electron beam 8 initially coincides with the tube axis. The inside of the face plate 3 is provided with a large number of triplets of phosphor elements. The elements may consist of lines or dots. Each triplet comprises an element consisting of a blue green luminescing phosphor, an element consisting of a green luminescing phosphor and an element consisting of a red green luminescing phosphor. All triplets combined constitute the display screen 10. The three co-planar electron beams are deflected by deflection means, for instance by a system of deflection coils 11. Positioned in front of the display screen is the shadow mask 12 in which a large number of elongated apertures 13 is provided through which the electron beams 7, 8 and 9 pass, each impinging only on phosphor elements of one colour. The shadow mask is suspended in the display window by means of suspension means 14. The device further comprises means 16 for supplying voltages to the electron gun system via feedthroughs 17. The colour cathode ray tube also comprises a so-called anode button 18. This anode button 18 is a high voltage lead through which in operation a high voltage is supplied to a third focusing electrode via a conducting layer on the inside on the cone of the envelope.

Figure 2:
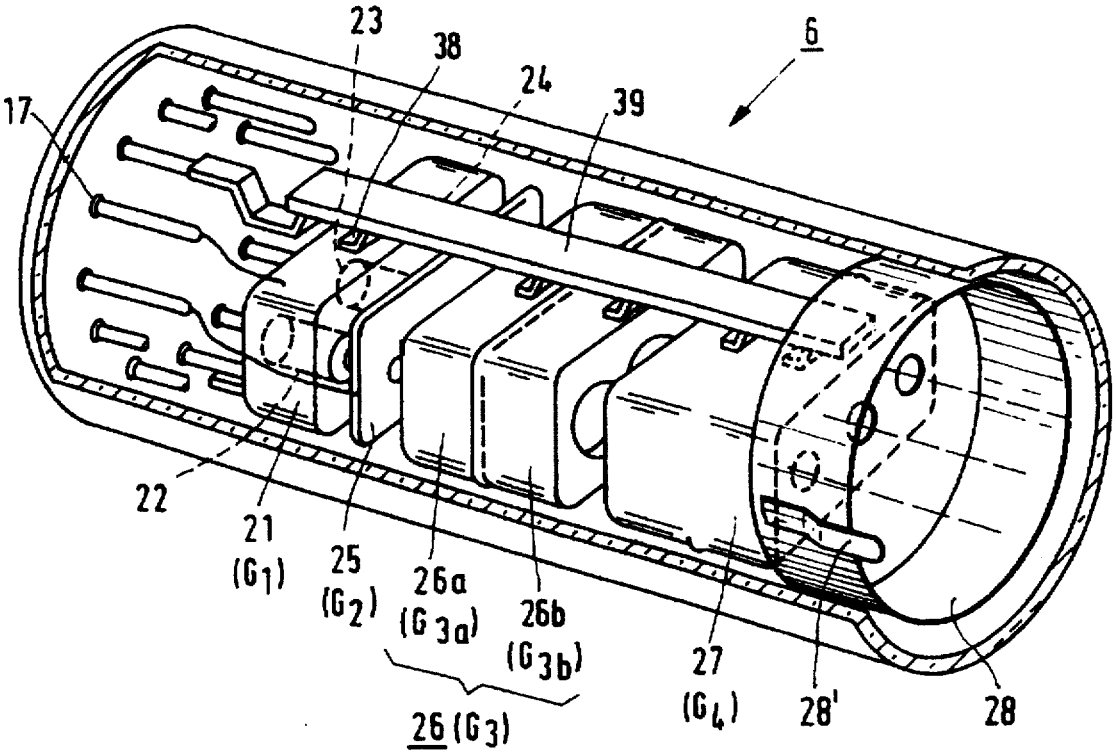
FIG. 2 is a perspective view of an electron gun as used in the colour display tube of FIG. 1.

FIG. 2 is a perspective view on an electron gun as used in the display tube shown in FIG. 1.

The electron gun system 6 comprises a common control electrode 21, also referred to as the G1-electrode, in which three cathodes 22, 23 and 24 are secured. In this example the G1-electrode forms the first pre-focusing electrode of the pre-focusing part of the electron gun. The electron gun system further comprises a common plate-shaped electrode 25, also referred to as the G2-electrode, which forms the second pre-focusing electrode of the pre-focusing part of the electron gun. The electron gun system further comprises a third common electrode 26, also referred to the G3-electrode, which electrode comprises two sub-electrode 26*a* and 26*b* (also referred to as the G3*a* and G3*b*-electrode). Sub-electrode 26*a* forms the first focusing electrode, and sub-electrode 26*b* forms the second focusing electrode. The electron gun further comprises a final accelerating electrode 27, (also referred to as the G4-electrode), which forms the third focusing electrode. All electrodes are via braces 38 connected to a ceramic carrier 39. Only one of these carriers is shown in this figure. The neck of the envelope is provided with electrical feedthroughs 17, electrical connection between the feedthroughs and some of the electrodes are schematically shown in FIG. 2. The electron gun also comprises at the end facing the display screen a centering cup 28. Said centering cup is usually provided with centering springs 28', of which, for simplicity only one is shown in FIG. 2. Said centering springs connect to the conducting layer on the inside of the cone.

Figure 3:
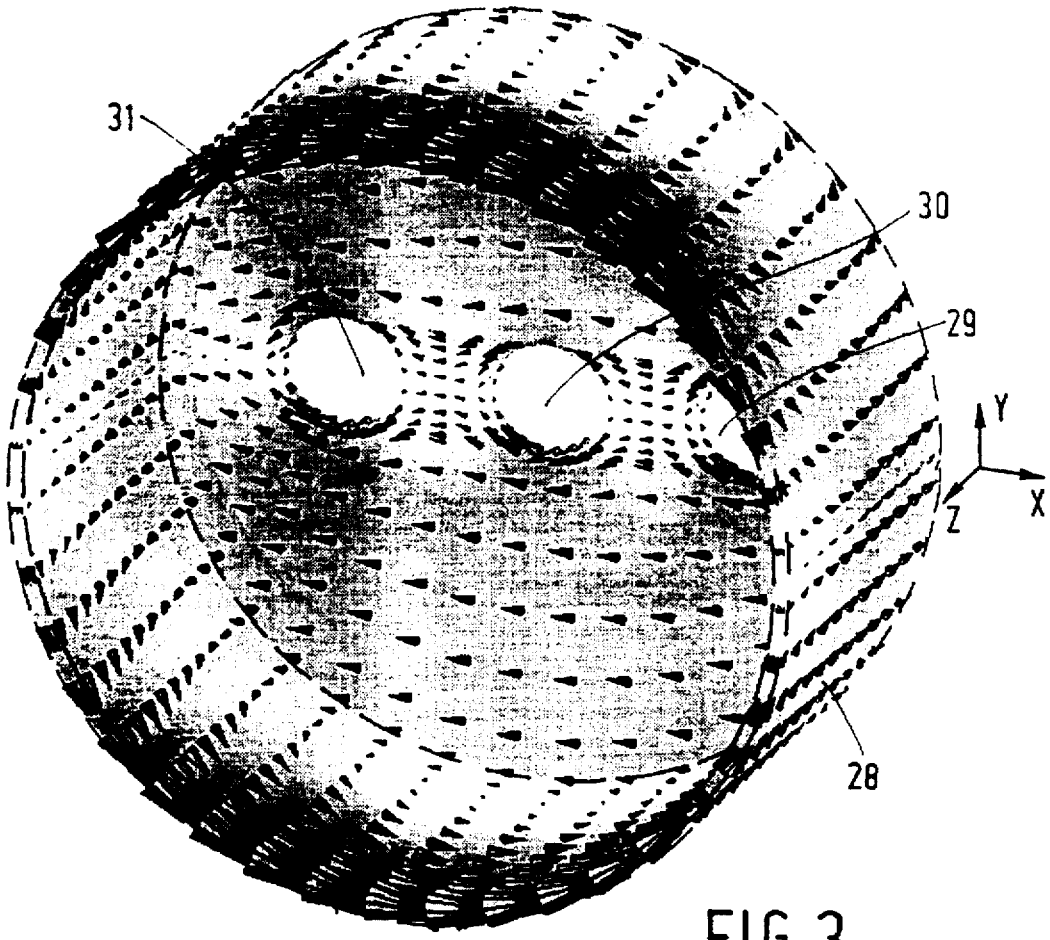
FIG. 3 is a perspective view of a centering cup without slits.

FIG. 3 shows a perspective view of a centering cup 28. The centering cup 28 is provided with three apertures 29, 30 and 31, for passing the electron beams 7, 8 and 9. The apertures are situated in an in-line plane, in this figure the x-z plane. The centering cup is usually made of non-ferromagnetic material. The high-frequency deflection field generated by the deflection unit 11 induces in the centering cup eddy currents, which eddy currents reduce the quality of the image. FIG. 3 shows by means of arrows the intensity of the eddy currents, as calculated by the inventors. The eddy currents are concentrated above and below (seen in the y-direction) the central aperture 30.

Figure 4A:
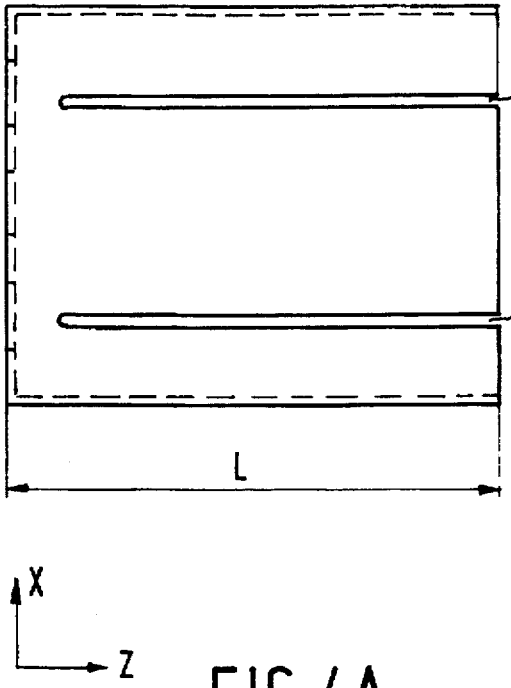
FIGS. 4A to 4C are respectively a side view, top view and perspective view of a centering cup with slits.
Figure 4B:
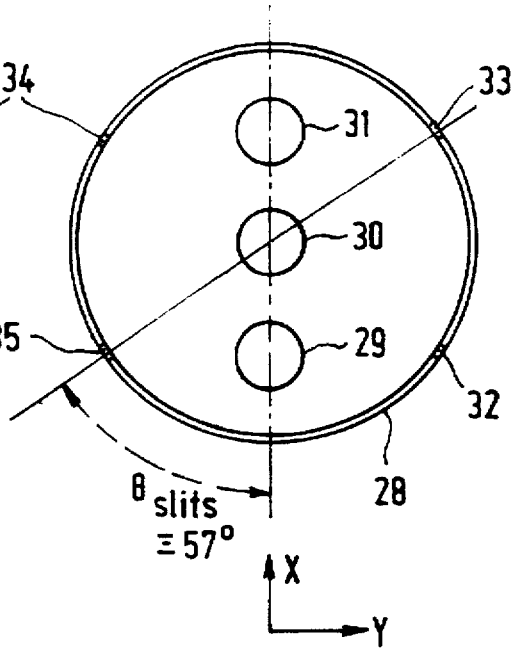
Figure 4C:
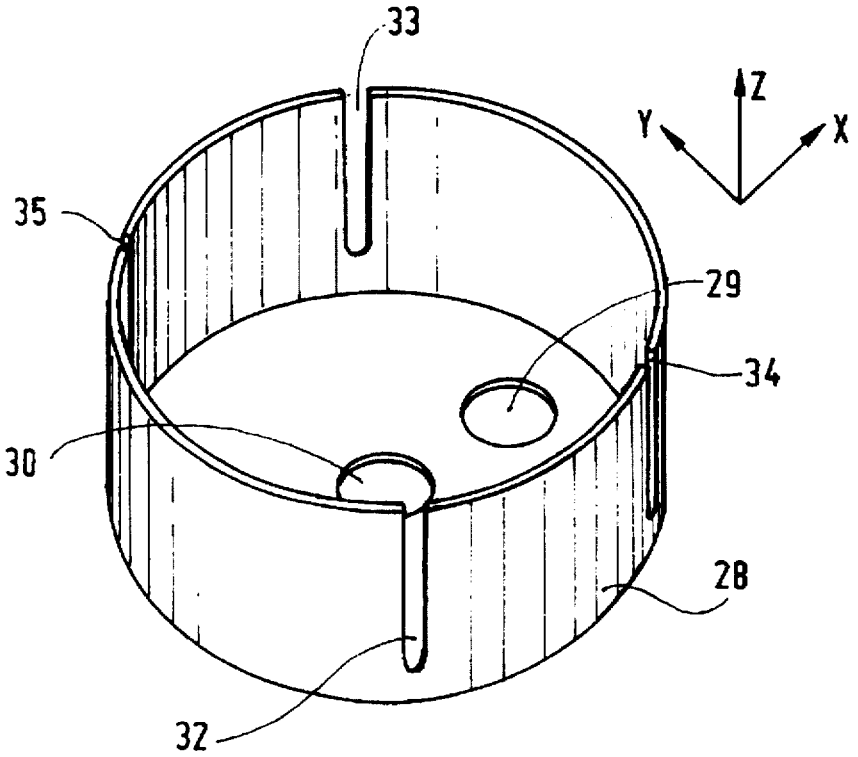

FIGS. 4A to 4C are respectively a side view, top view and perspective view of a centering cup 28 with slits 32, 33, 34 and 35. Within the framework of the invention it has been found that the position of the slits vis-a-vis the in-line plane is of importance. The four slits are positioned substantially mirror-symmetrical with respect to the in-line plane (the x-z plane) and with respect to a plane perpendicular to the in-line plane through the central aperture (the y-z plane), a line drawn through two slits and the central opening making an angle $\theta_{slits}$ with the in-line plane ranging between 51 and 63 degrees. More in particular the angle $\theta_{slits}$ which is the angle taken through two opposite slits and through the central apertures, is of importance as is more clearly shown in FIG. 5. The slits are open at the side of the centering cup facing the display screen and preferably have a length of at least 50% of the length of the centering cup, which increases the effectiveness of the slits in regards of reducing eddy currents.

Figure 5:
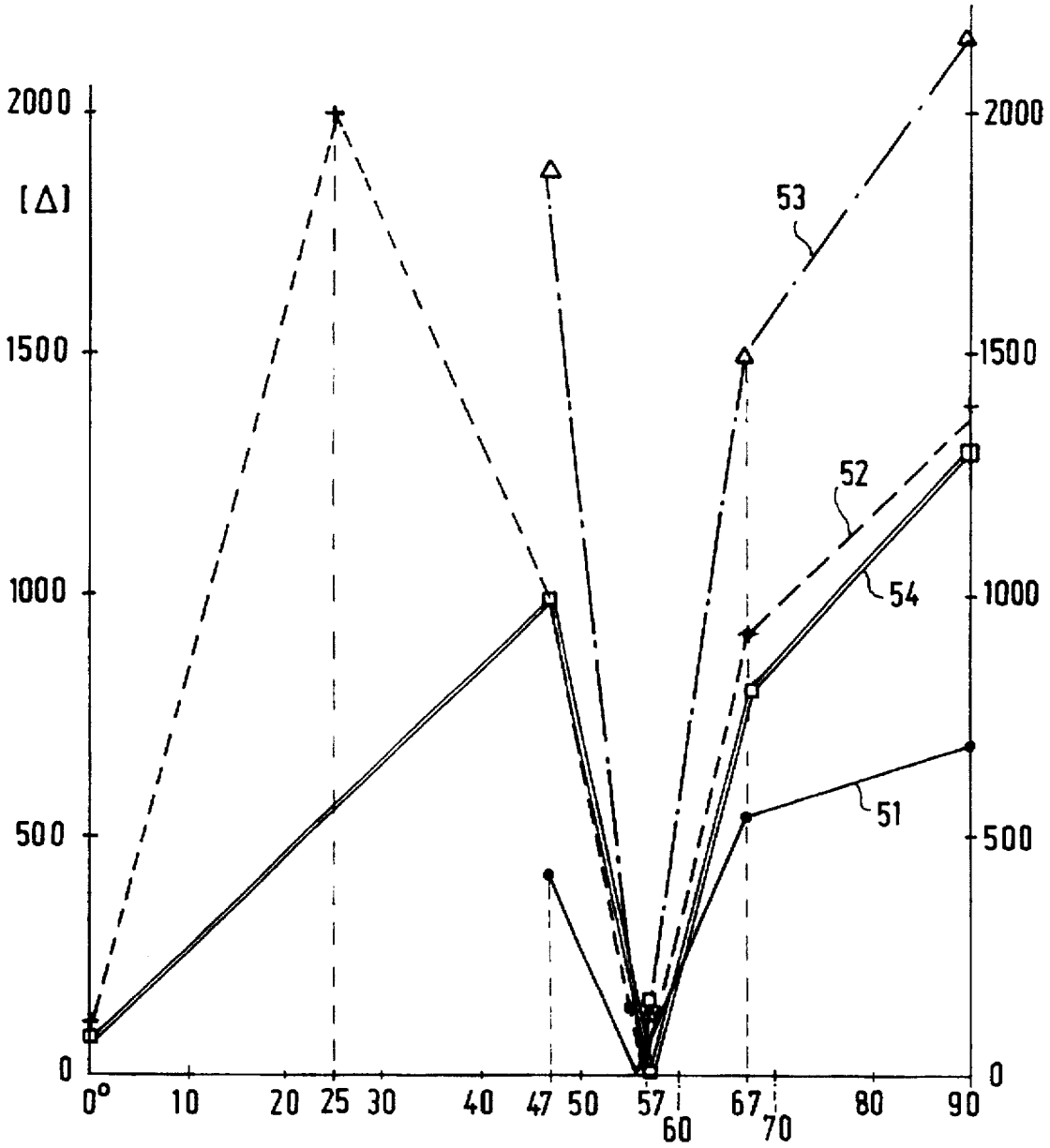
FIG. 5 shows in graphical form the dependency of the convergence error Δ on the position of the slits.

FIG. 5 shows the effect of introducing slits on the convergence error. When a convergence error occurs the outer electron beams do not coincide on the display screen with the central electron beam, which non-coincidence causes a deterioration of the image displayed on the screen. The amount of non-convergence of the electron beams on the screen in absolute value is given in FIG. 5 in micrometers. The dots in FIG. 5, through which, for guidance of the eye, full line 51 is drawn, are the results of calculations for a centering cup having a length of 20 mm. The crosses, through which dashed line 52 is drawn, are the results of calculations for a centering cup having a length (L, see FIG. 3A) of 24 mm. The triangles (dash-dotted line 53) correspond to a centering cup having a length L of 28 mm. Finally the squares (double line 54) represent experimental results for a centering cup having a length L of 24 mm. As can be seen in FIG. 5 the convergence error $|\Delta|$ resulting from the introduction of the slits is very large (in the order of 1000 to 2000 micrometer, which is clearly detrimental to the picture quality) for an angle of 90° (which corresponds to two slits above and below the central aperture 30), is somewhat reduced at angles to approximately 70°, and has a sharp minimum between 51° and 63°, rising again to large values for smaller angles. It is remarked that for very small angles (around 0°) the convergence errors are also small (calculations and experimental values for a centering cup having a length of 24 mm are shown in FIG. 5), however, for such angles the eddy current reducing effect of the slits is negligible. An angle $\theta_{slits}$ of 0° corresponds to two slits to the left and the right of the two outer beams. However, as can be seen in FIG. 3 at those positions the slits are parallel to the eddy currents so that the effect on the eddy currents of such slits is negligible.

Figure 6:
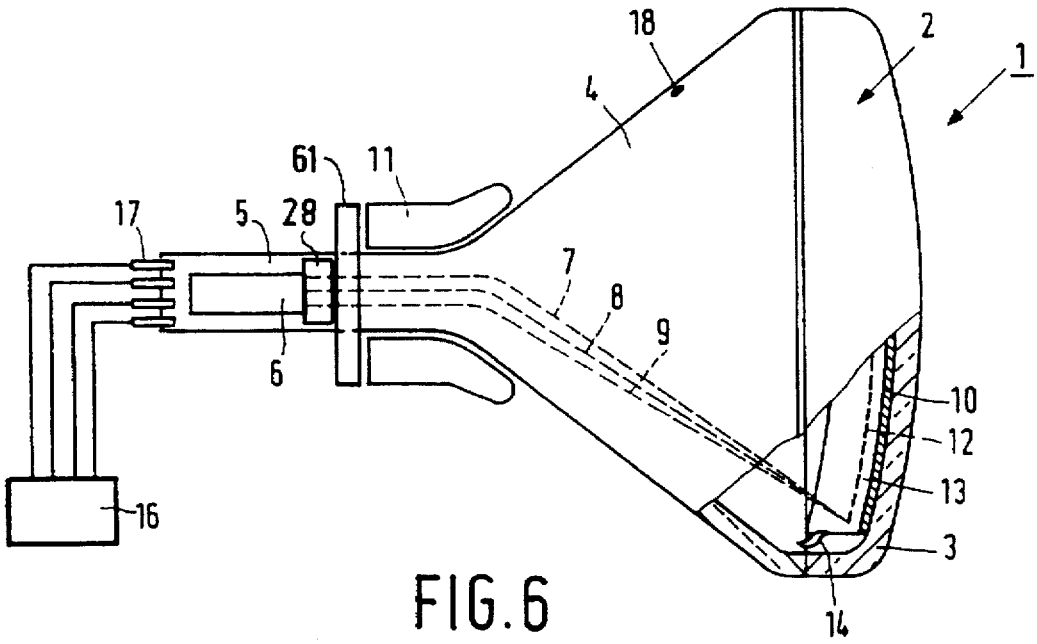
FIG. 6 is a longitudinal section of a further embodiment of a colour cathode ray tube according to the invention.

FIG. 6 shows a cathode ray tube for which the invention is particularly advantageous. Around the neck, in front of the deflection unit, an additional coil 61 for generating an alternating electro-magnetic field is provided. Such a coil can be for instance a Scan-Velocity Modulating coil. When such additional fields are used, the eddy currents in the centering cup are particularly strong.

It will be clear that within the framework of the invention many variations are possible. For instance the centering cup is provided with four slits in a cross-form. The provision of such slits does not excluded extra slits, for instance at 0° or 90°.

I claim:

1. A colour cathode ray tube comprising in an evacuated envelope an in-line electron gun for generating three electron beams situated in one plane, said electron beams being directed to a display screen on an interior portion of the evacuated envelope, and a deflection unit for deflecting the electron beams over the screen, said electron gun comprising a centering cup at the end of the electron gun facing the display screen, said centering cup having a central and two outer apertures for passing the three electron beams, characterized in that, the centering cup is provided with four slits, positioned substantially mirror-symmetrical with respect to the in-line plane and with respect to a plane perpendicular to the in-line plane through the central aperture, a line drawn through two slits and the central opening making an angle with the in-line plane ranging between 51 and 63 degrees.

2. A colour cathode ray tube as claimed in claim 1, characterized in that the slits have a length of at least 50% of the length (L) of the centering cup.

* * * * *